US012553444B2

(12) United States Patent
Kabasawa

(10) Patent No.: US 12,553,444 B2
(45) Date of Patent: Feb. 17, 2026

(54) VACUUM PUMP

(71) Applicant: Edwards Japan Limited, Yachiyo (JP)

(72) Inventor: Takashi Kabasawa, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 209 days.

(21) Appl. No.: 17/908,475

(22) PCT Filed: Mar. 2, 2021

(86) PCT No.: PCT/JP2021/008025
§ 371 (c)(1),
(2) Date: Aug. 31, 2022

(87) PCT Pub. No.: WO2021/182198
PCT Pub. Date: Sep. 16, 2021

(65) Prior Publication Data

US 2023/0097903 A1 Mar. 30, 2023

(30) Foreign Application Priority Data

Mar. 9, 2020 (JP) ..... 2020-040374

(51) Int. Cl.
*F04B 37/14* (2006.01)
*F04B 39/00* (2006.01)
(Continued)

(52) U.S. Cl.
CPC ..... *F04D 19/042* (2013.01); *F04B 37/14* (2013.01); *F04B 39/00* (2013.01); *F04D 19/04* (2013.01); *F04D 29/701* (2013.01)

(58) Field of Classification Search
CPC ..... F04B 37/14; F04B 39/00; F04D 19/042; F04D 29/701; F04D 19/04; F05D 2260/607
(Continued)

(56) References Cited

U.S. PATENT DOCUMENTS 4,707,210 A * 11/1987 Misumi ..... C23C 16/4401 156/345.43
5,611,660 A * 3/1997 Wong ..... F04D 19/046 415/90
(Continued)

FOREIGN PATENT DOCUMENTS

CN 1860299 A 11/2006
CN 110366640 A 10/2019
(Continued)

OTHER PUBLICATIONS

Machine Translation of WO 2016002320 A1 retrieved from WIPO patentscope on Jun. 16, 2024 (Year: 2024).*
(Continued)

*Primary Examiner* — Essama Omgba
*Assistant Examiner* — Dnyanesh G Kasture
(74) *Attorney, Agent, or Firm* — Shumaker & Sieffert, P.A.

(57) ABSTRACT

A vacuum pump which can decompose depositions by radicals and effectively exhaust them is provided. The vacuum pump including a casing, a stator disposed on an inner side of the casing, and a shaft rotatably supported with respect to the stator and also including a cylindrical rotor rotatably enclosed together with the shaft in the casing, in which an electrode portion, which is a part of a radical generating device that generates radicals, is disposed in the casing.

8 Claims, 4 Drawing Sheets

(51) Int. Cl.
*F04D 19/04* (2006.01)
*F04D 29/70* (2006.01)

(58) Field of Classification Search
USPC ..... 95/57–81; 96/15–100
See application file for complete search history.

(56) References Cited

U.S. PATENT DOCUMENTS

| | | | | |
|---|---|---|---|---|
| 6,105,589 | A * | 8/2000 | Vane | H01J 37/32055 134/1.1 |
| 6,224,326 | B1 | 5/2001 | Puech | |
| 2007/0031263 | A1* | 2/2007 | Stones | F04D 19/046 417/199.2 |
| 2007/0074662 | A1* | 4/2007 | Hirota | C23C 16/4412 118/723 R |
| 2008/0236629 | A1 | 10/2008 | Sugawara et al. | |
| 2009/0045165 | A1* | 2/2009 | Narishige | H01L 21/31138 216/41 |
| 2010/0071548 | A1* | 3/2010 | Smith | C23C 16/4412 95/3 |
| 2012/0016446 | A1* | 1/2012 | Panting | A61N 1/32 607/2 |
| 2012/0087776 | A1* | 4/2012 | Henry | F04D 29/522 415/60 |
| 2012/0241412 | A1* | 9/2012 | Murakami | H01J 37/32495 156/345.24 |
| 2019/0120236 | A1* | 4/2019 | Kabasawa | F04D 19/046 |
| 2019/0153234 | A1* | 5/2019 | Hoermann | C09C 1/485 |
| 2020/0058479 | A1* | 2/2020 | Steiner | F04D 17/02 |
| 2020/0095998 | A1 | 3/2020 | Kabasawa | |
| 2021/0018003 | A1 | 1/2021 | Kabasawa | |
| 2023/0097903 | A1 | 3/2023 | Kabasawa | |

FOREIGN PATENT DOCUMENTS

| | | | | |
|---|---|---|---|---|
| CN | 110382997 | A | 10/2019 | |
| CN | 110863989 | A | 3/2020 | |
| DE | 10115394 | A1 | 10/2002 | |
| EP | 0985828 | A1 | 3/2000 | |
| FR | 2822732 | A1 | 10/2002 | |
| GB | 2378037 | A | 1/2003 | |
| JP | H01305197 | A | 12/1989 | |
| JP | H02271098 | A | 11/1990 | |
| JP | 2008248825 | A | 10/2008 | |
| JP | 7361640 | B2 | 10/2023 | |
| KR | 102530772 | B1 | 5/2023 | |
| WO | WO-2016002320 | A1 * | 1/2016 | F04B 37/14 |
| WO | 2018164013 | A1 | 9/2018 | |
| WO | 2018173704 | A1 | 9/2018 | |
| WO | 2019122873 | A1 | 6/2019 | |

OTHER PUBLICATIONS

Extended Search Report from counterpart European Application No. 21768777.1 dated Mar. 12, 2024, 7 pp.
International Search Report and Written Opinion of International Application No. PCT/JP2021/008025 dated Apr. 27, 2021, 9 pp.
Office Action, and translation thereof, from counterpart Chinese Application No. 202180017185.5 dated Oct. 9, 2025, 18 pp.
Office Action, and translation thereof, from counterpart Korean Application No. 10-2022-7028182 dated Oct. 15, 2025, 11 pp.
Search Report from counterpart Malaysian Application No. PI2022004877 dated Nov. 30, 2025, 1 pg.

* cited by examiner

VACUUM PUMP

This application is a U.S. national phase application under 35 U.S.C. § 371 of international application number PCT/JP2021/008025 filed on Mar. 2, 2021, which claims the benefit of JP application number 2020-040374 filed on Mar. 9, 2020. The entire contents of each of international application number PCT/JP2021/008025 and JP application number 2020-040374 are incorporated herein by reference.

TECHNICAL FIELD

The present disclosure relates to a vacuum pump and particularly relates to a vacuum pump in which depositions and the like generated by solidification of a gas in the vacuum pump can be eliminated.

BACKGROUND

In recent years, in a process of forming a semiconductor element from a wafer, which is a substrate to be processed, a method of manufacturing a semiconductor element product by processing the wafer in a process chamber of a semiconductor manufacturing device held at a high vacuum has been employed. In the semiconductor manufacturing device, which works/processes the wafer in the vacuum chamber, a vacuum pump including a turbo-molecular pump portion and a thread groove pump portion and the like is used in order to achieve and keep the high vacuum degree (see Japanese Patent Application Publication No. 2019-82120, for example).

The turbo-molecular pump portion has a rotatable rotor blade made of thin metal and a stator blade fixed to a casing inside the casing. And the rotor blade is driven at a high speed of several hundred m/second, for example, so that a process gas entering from an inlet port side and used for the processing is compressed inside the pump and is exhausted from an outlet port side.

By the way, a molecule of the process gas having been taken in through the inlet port side of the vacuum pump hits a stator-blade blade by movement toward the outlet port side by a rotor-blade blade while advancing toward the outlet port side and is adsorbed by the stator-blade blade, a casing inner surface and the like and deposited. The deposition adsorbed by the stator-blade blade or the casing inner surface prevents advance of gas molecules toward the outlet port side. As a result, problems such as lowering of exhaustion capacity of the turbo-molecular pump, abnormality in processing pressure, lowered production efficiency caused by processing stop of the depositions and the like have occurred.

Moreover, such a problem occurred that the depositions peeled off the stator blade or the casing inner surface backflow to the process chamber of the semiconductor manufacturing device and contaminate the wafer.

As a measure against it, a vacuum pump in which a radical supply device that generates radicals for separating and decomposing the depositions adsorbed and deposited on the stator-blade blade, the casing inner surface and the like is provided at the inlet port of the vacuum pump is proposed (see Japanese Patent Application Publication No. 2008-248825, for example).

In the art known by Japanese Patent Application Publication No. 2008-248825, a radical supply portion is provided in the vicinity of the inlet port of the vacuum pump so that the radicals are supplied by injecting the radicals from a nozzle of the radical supply portion toward a center of the inner side.

SUMMARY

The disclosure described in Japanese Patent Application Publication No. 2008-248825 employs a configuration in which the radicals from the radical supply portion are supplied by injection from a nozzle provided in the vicinity of the inlet port toward a center of the inner side. And the radicals supplied from the radical supply portion are caused to flow with the process gas toward an outlet port side in a casing and, in the middle of it, decompose depositions adsorbed on the stator-blade blade, an inner surface of the casing and the like and are exhausted together with the process gas through the outlet port. Such radicals are unstable substances which forcedly separate molecular binding by giving a large amount of energy to a material gas and thus, they are bound again in a relatively short time and lose activity. Therefore, even if they are supplied from the inlet port of the vacuum pump, they are bound again before reaching the vicinity of the outlet port of the vacuum pump due to collision between the radicals, collision and the like against the stator-blade blade and the casing and lose activity.

On the other hand, the depositions of the process gas are deposited mainly in the vicinity of the outlet port of the vacuum pump and thus, there was a problem that they cannot be effectively cleaned, even if the radicals are supplied to the vicinity of the inlet port.

Moreover, when the radical supply portion is to be installed in the vicinity of the inlet port of the vacuum pump, with the configuration in which the radicals are supplied by injection from the nozzle of the radical supply portion toward the center of the inner side, the radicals cannot be caused to flow evenly to the entire passage through which the process gas flows. That is, the radicals are sufficiently supplied to a spot close to a nozzle flow outlet and thus, cleaning can be performed effectively, but at a spot far away from the nozzle flow outlet, the supply of the radicals is small, and cleaning cannot be performed. Even if the radicals are pulled around in a circumferential direction by a manifold or the like, they are bound together again in the manifold, and cleaning capacity is reduced, which was a problem. Therefore, in order to clean the entire vacuum pump, the nozzles of the radical supply portion need to be aligned and installed in plural in the circumferential direction, whereby costs are raised, which was also a problem.

Thus, a technical problem to be solved is generated in order to provide a vacuum pump which can decompose depositions by radicals and is capable of effective exhaustion, and the present disclosure has an objective to solve this problem.

The present disclosure was proposed to achieve the aforementioned object, and an invention described in a first aspect provides a vacuum pump including a casing, a stator disposed on an inner side of the casing, and a cylindrical rotor having a shaft rotatably supported with respect to the stator and rotatably enclosed in the casing together with the shaft, in which at least a pair of electrodes that generate radicals are disposed in the casing.

According to this configuration, in the casing, at least a pair of the electrodes of the radical generating device that generates the radicals are provided. The pair of electrodes generate the radicals in the casing, that decompose the depositions deposited inside the casing. And when the radicals generated in the casing are brought into contact with the depositions in the casing, a molecular chain on a surface of the deposition is cut off, and the deposition is decomposed into a low molecular weight gas. Moreover, the gas decomposed to the low molecular weight is transferred to the outlet port of the vacuum pump and is effectively exhausted to the outside through the outlet port of the vacuum pump.

In addition, by providing at least a pair of the electrodes of the radical generating device in the casing at a spot where the depositions of the process gas can be generated easily, the depositions can be effectively decomposed and can be effectively exhausted to the outside.

An invention described in a second aspect provides, in the configuration described in the first aspect, a vacuum pump further including a power source that applies a high-frequency voltage to the electrodes.

According to this configuration, by disposing at least a pair of the electrodes in the passage through which the process gas flows in the casing and by applying the high-frequency voltage to a space between the electrodes from the power source, the radicals can be effectively generated in the passage through which the process gas flows in the casing. The power source may be disposed on either one of an outer side and an inner side of the casing.

An invention described in a third aspect provides, in the configuration described in the first aspect or the second aspect, a vacuum pump in which the electrode is constituted by disposing a plurality of cylindrically formed plate materials substantially at equal intervals concentrically with an axial center of the shaft.

According to this configuration, by cylindrically forming the plate materials of the electrode that generates the radicals of the radical generating device in plural and with different diameters, for example, by disposing the plurality of cylindrical plate materials substantially at equal intervals concentrically with the axial center of the shaft, and by disposing them in a form crossing the entire passage through which the process gas flows in the casing, the electrodes of the radical generating device can be disposed substantially evenly over the entire passage through which the process gas flows in the casing. As a result, the radicals are generated substantially evenly over the entire passage through which the process gas flows in the casing and are brought into contact with the entire depositions deposited in the casing, and cleaning can be performed effectively. Moreover, by cylindrically forming the plurality of the electrodes of the radical generating device and by disposing them in the form crossing the entire passage through which the process gas flows in the casing, a space occupied by the radical generating device in the casing can be made smaller and compact and thus, a size of the vacuum pump can be reduced.

An invention described in a fourth aspect provides, in the configuration described in any one of the first aspect, the second aspect, or the third aspect, a vacuum pump including a turbo-molecular pump portion in which a plurality of rotor-blade blades protruding from an outer peripheral part of the rotor are provided, and stator-blade blades protruding from an inner peripheral part of the casing, separated away in the axial direction with respect to the rotor-blade blades, and disposed by surface-facing the rotor-blade blades is provided.

According to this configuration, a structure that can effectively decompose and exhaust the depositions of the process gas generated in the casing by the vacuum pump including the turbo-molecular portion can be obtained.

An invention described in a fifth sapect provides, in the configuration described in any one of the first aspect, the second aspect, the third aspect, or the ourth aspect, a vacuum pump including a thread-groove pump portion constituted by providing a spiral or a coiled thread groove at least in either one of the outer peripheral part of the rotor and the inner peripheral part of the stator.

According to this configuration, a structure that can effectively decompose and exhaust the depositions of the process gas generated in the casing by the vacuum pump including the thread-groove pump portion or both the thread-groove pump portion and the turbo-molecular portion can be obtained.

An invention described in a sixth aspect provides, in the configuration described in any one of the first aspect, the second aspect, the third aspect, the fourth aspect, or the fifth aspect, a vacuum pump including a turbo-molecular pump portion in which a plurality of rotor-blade blades protruding from an outer peripheral part of the rotor are provided and stator-blade blades protruding from an inner peripheral part of the casing, separated away in the axial direction with respect to the rotor-blade blades, and disposed by surface-facing the rotor-blade blades are provided and a thread-groove pump portion in which a spiral or coiled thread groove is provided at least in either one of the outer peripheral part of the rotor and the inner peripheral part of the stator are provided, and the electrodes are provided on a boundary of the turbo-molecular pump portion and the thread-groove pump portion.

According to this configuration, by providing the electrodes and the like of the radical generating device on the boundary of the turbo-molecular pump portion and the thread-groove pump portion, the depositions of the process gas deposited in the periphery of the boundary position of the turbo-molecular pump portion and the thread-groove pump portion can be effectively decomposed and favorably exhausted to the outside, and cleaning can be performed.

An invention described in a seventh aspect provides, in the configuration in any one of the first aspect, the second aspect, the third aspect, the fourth aspect, the fifth aspect, or the sixth aspect, a vacuum pump in which the electrodes are provided closer to the inlet port side than the rotor.

According to this configuration, by providing the electrodes of the radical generating device closer to the inlet port side than the rotor, a space for disposing the electrodes of the radical generating device can be taken wide, and more electrodes for generating radicals can be disposed. As a result, more radicals can be generated, the depositions can be further effectively decomposed and exhausted to the outside, and cleaning can be performed.

An invention described in an eighth aspect provides, in the configuration described in any one of the first aspect, the second aspect, the third aspect, the fourth aspect, the fifth aspect, the sixth aspect, or the seventh aspect, a vacuum pump in which the electrodes are provided at a position in the middle in an axial direction of the rotor.

According to this configuration, by providing the electrode of the radical generating device at the position in the middle in the axial direction of the rotor, the process gas taken in through the inlet port and deposited in a periphery of the position in the middle in the axial direction in the casing can be effectively removed. The radicals are unstable substances and forcedly separate molecular binding by giving large energy to a material gas. Thus, they have a demerit that they are bound again in a relatively short time and lose activity. On the other hand, the process gas is deposited in the casing mainly in the vicinity of the outlet port. Therefore, even by supplying the radicals in the vicinity of the inlet port, effective cleaning cannot be performed in some cases.

However, with this configuration, since the electrode, which is a part of the radical generating device, is provided at the position in the middle in the axial direction of the rotor, the depositions of the process gas deposited in the vicinity of the outlet port can be effectively decomposed and favorably exhausted to the outside, and the cleaning can be performed.

An invention described in a ninth aspect provides, in the configuration described in any one of the first aspect, the second aspect, the third aspect, the fourth aspect, the fifth aspect, the sixth aspect, the seventh aspect, or the eighth aspect, a vacuum pump in which a purge-gas supply port that supplies a purge gas is provided on an upstream side of the electrode in the casing.

According to this configuration, by causing the purge gas such as O2 (oxygen), NF3 (nitrogen trifluoride) and the like, for example, to flow from the purge-gas supply port provided on the upstream side of the electrode of the radical generating device, O(oxygen) radicals and F(fluorine) radicals are generated, and the generated O-radicals, F-radicals and the like decompose the deposition of the process gas into a low molecular weight gas and can exhaust it to the outside through the outlet port. As a result, the depositions deposited in the casing can be further reduced.

An invention described in a tenth aspect provides, in the configuration described in any one of the first aspect, the second aspect, the third aspect, the fourth aspect, the fifth aspect, the sixth aspect, the seventh aspect, the eighth aspect, or the ninth aspect, a vacuum pump having a control portion capable of switching control of the rotor between rated rotation and a low-speed rotation at a speed lower than the rated speed.

According to this configuration, when the O-radicals, F-radicals and the like are generated by supplying the purge gas such as O2, NF3 and the like, for example, there is a concern that the purge gas backflows. However, by rotating the rotor at a low speed, backflow of the gasified purge gas such as the O-radicals, F-radicals, and the like to the device side such as a sealed chamber connected to an inlet side can be prevented, and erosion of the device connected to the inlet side by the purge gas can be prevented.

According to the disclosure, the depositions deposited in the casing can be decomposed into a low molecular weight gas by the radicals and can be effectively exhausted to the outside through the outlet port of the vacuum pump. Moreover, by providing at least the electrode of the radical generating device at a spot where the depositions of the process gas can be generated easily in the casing, the depositions can be decomposed and exhausted more effectively and thus, the depositions deposited in the casing are reduced. As a result, a maintenance cycle of the pump can be extended. As a result, a frequency of removing the vacuum pump from the vacuum chamber or the like for overhauling can be decreased, and productivity of the manufacturing devices of semiconductor, flat panels and the like can be improved.

BRIEF DESCRIPTION OF THE DRAWINGS

FIGS. 2A and 2B are diagrams illustrating an example of an electrode configuration in a radical generating device installed in a casing of the vacuum pump, in which FIG. 2A is a plan view of the electrode configuration, and FIG. 2B is an A-A line arrow-view sectional diagram in FIG. 2A.

DETAILED DESCRIPTION

In order to achieve the object to provide a vacuum pump which can decompose depositions by radicals and effectively exhaust them, the present disclosure was realized by having such configuration of the vacuum pump having a casing, a stator disposed on an inner side of the casing, and a cylindrical rotor having a shaft rotatably supported with respect to the stator and enclosed in the casing together with shaft, in which at least a pair of electrodes generating the radicals is disposed in the casing.

EXAMPLE

Hereinafter, an example according to an example of the present disclosure will be described in details on the basis of the attached drawings. In the following examples, when the number, numeral values, amounts, ranges, and the like of constituent elements are referred to, except a case of explicit indication in particular and a case limited to a specific number obviously in principle, they are not limited to the specific numbers and may be equal to the specific number or more or less.

Moreover, when shapes and positional relationships of the constituent elements and the like are referred to, they include those substantially proximate to or similar to the shapes and the like except a case explicitly indicated in particular and a case obviously considered not to be so in principle.

Moreover, in order to facilitate understanding of features in drawings, featured parts might be exaggerated by enlargement or the like in some cases, and a dimensional ratio and the like of the constituent elements are not necessarily equal to the actual. Furthermore, in sectional diagrams, hatching of some constituent elements might be omitted in some cases in order to facilitate understanding of sectional structures of the constituent elements.

Moreover, in the following description, expressions indicating directions such as up and down, left and right and the like are not absolute but they are appropriate when each part of the vacuum pump of the present disclosure is in a depicted attitude, but when the attitude is changed, they should be interpreted with a change according to the change in the attitude. Furthermore, the same signs are given to the same elements throughout the entire description of the example.

Figure 1:
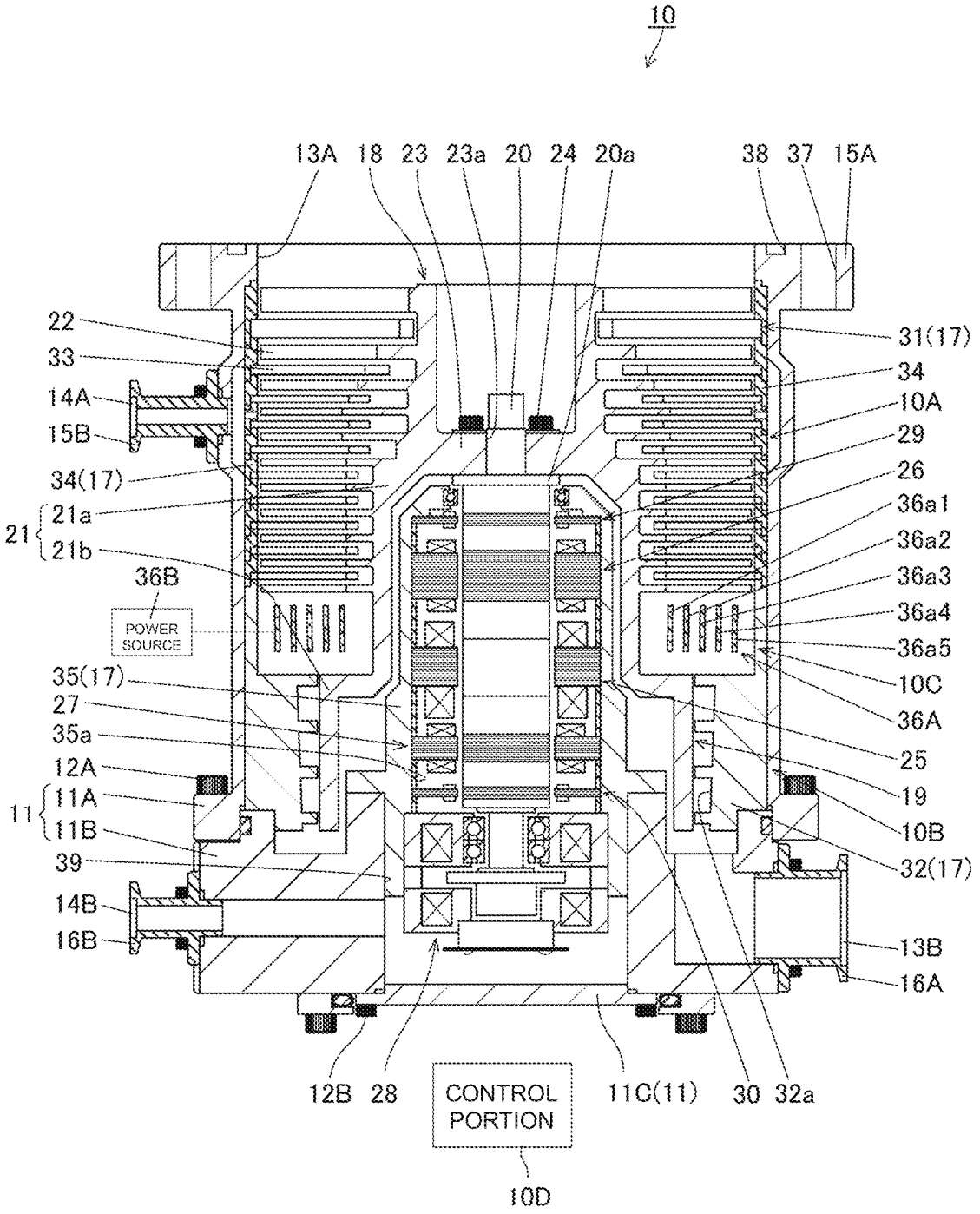
FIG. 1 is a schematic vertical sectional side view of a vacuum pump according to an example of the present disclosure.

FIG. 1 is a schematic vertical section side view of a vacuum pump 10 illustrated as an example according to an example of the present disclosure. In the following description, explanation will be made with an up-down direction in FIG. 1 as up and down of the vacuum pump.

The vacuum pump 10 shown in FIG. 1 is a complex pump (also called a "turbo-molecular pump") including a turbo-molecular pump portion 10A as a gas exhaustion mechanism, a thread-groove pump portion 10B, and a radical generating device 10C. The vacuum pump 10 is used as a gas exhausting means for a process chamber or other sealed chamber in a semiconductor manufacturing device, a flat panel display manufacturing device, and a solar panel manufacturing device, for example, and the entire operation is performed in accordance with a procedure determined by a control portion 10D.

The vacuum pump 10 includes a casing 11 inclusively enclosing the turbo-molecular pump portion 10A which exerts the exhaustion function, the thread-groove pump portion 10B, and at least a part of the radical generating device 10C which decomposes and exhausts the depositions deposited inside the vacuum pump 10.

The casing 11 has a cylindrical pump case 11A, a pump base 11B, and a base end lid 11C disposed in a cylinder axial direction thereof, the pump case 11A and the pump base 11B connected by a fastening member 12A, and the pump base 11B and the base end lid 11C connected by a mounting bolt 12B so as to be formed having a substantially cylindrical shape with a bottom.

An upper end portion side of the pump case 11A (upper side on a paper face in FIG. 1) is open as an inlet port 13A, and a first purge-gas supply port 14A communicating with an inside of an electrode portion 36A of the radical generating device 10C is provided in a peripheral surface of the upper end portion side. In the inlet port 13A, a flange 15A is formed. To the flange 15A of the inlet port 13A, a sealed chamber, not shown, with a high vacuum such as a process chamber of the semiconductor manufacturing device and the like is made to communicate with and is connected. On the flange 15A, a bolt hole 37 into which a bolt, not shown, is inserted and an annular groove 38 to which an O-ring for keeping airtightness with a flange on the sealed chamber side is attached is formed.

On the other hand, to the flange 15B of the first purge-gas supply port 14A, a purge-gas supply device, not shown, is made to communicate with and is connected. And to the flange 15B of the first purge-gas supply port 14A, a purge-gas supply device, not shown, is made to communicate with and is connected, and the purge gas such as O2 (oxygen), NF3 (nitrogen trifluoride) and the like is supplied from the purge-gas supply device to the first purge-gas supply port 14A, for example.

On the other hand, on the pump base 11B, an outlet port 13B and a second purge-gas supply port 14B are provided. On the outlet port 13B, a flange 16A is provided, and a flange 16B is provided on a second purge-gas supply port 14B. To the flange 16A on the outlet port 13B, an auxiliary pump and the like, not shown, are made to communicate with and are connected. To the flange 16B of the second purge-gas supply port 14B, another auxiliary pump separate from the auxiliary pump communicating with and connected to the first purge-gas supply port 14A is connected, and from the second purge-gas supply port 14B, an inactive gas such as N2 (nitrogen) gas, Ar (argon) gas or the like is made to flow. The second purge-gas supply port 14B communicates with an inside of a stator column 35, which will be described later, and by supplying the purge gas into an electric-component accommodating portion 35*a* of the stator column 35 (cylindrical inside of the stator column 35), the second purge-gas supply port 14B is used for protecting electric components from a corrosive gas which might be contained in the process gas or the like exhausted from the sealed chamber connected to the vacuum pump 10.

The example shown in FIG. 1 has such a structure that the vacuum pump 10 is disposed vertically, but the vacuum pump 10 may be mounted laterally to a side of the sealed chamber or may be mounted on an upper part of the sealed chamber with the inlet port 13A on a lower side.

By describing the structure of the vacuum pump 10 in more detail, a construction exerting the exhaustion function is roughly constituted by a stator 17 fixed in the casing 11 and a rotor 18 disposed relatively rotatably with respect to the stator 17 and the like.

The rotor 18 is constituted by a rotor blade 19 and a shaft 20 and the like.

The rotor blade 19 has a cylinder member 21 in which a first cylinder portion 21*a* disposed on the inlet port 13A side (turb-molecular pump portion 10A) and a second cylinder portion 21*b* disposed on the outlet port 13B side (thread-groove pump portion 10B) are integrally formed.

The first cylinder portion 21*a* is a member having a schematically cylindrical shape and constitutes the rotor blade portion of the turbo-molecular pump portion 10A. An outer peripheral surface of the first cylinder portion 21*a*, that is, an outer peripheral portion of the rotor 18 has a plurality of rotor-blade blades 22 extending radially outward from a surface in parallel with an axial center of the rotor blade 19 and the shaft 20 provided at substantially equal intervals in a rotating direction. Moreover, each of the rotor-blade blades 22 is inclined in the same direction only by a predetermined angle with respect to the horizontal direction. And in the first cylinder portion 21*a*, the plurality of rotor-blade blades 22 extending radially are formed in plural stages at predetermined intervals in an axial direction.

Moreover, a partition wall 23 to be joined to the shaft 20 is formed in the middle in the axial direction of the first cylinder portion 21*a*. In the partition wall 23, a shaft hole 23*a* for mounting an upper end side of the shaft 20 by insertion and a bolt hole, not shown, in which the mounting bolt 24 fixing the shaft 20 and the rotor blade 19 is mounted are formed.

The second cylinder portion 21*b* is a member with an outer peripheral surface having a cylindrical shape and constitutes a rotor blade portion of the thread-groove pump portion 10B.

The shaft 20 is a columnar member constituting a shaft of the rotor 18, and a flange portion 20*a* screwed with/fixed to the partition wall 23 of the first cylinder portion 21*a* through the mounting bolt 24 is integrally formed on an upper end portion. And the shaft 20 has the upper end portion inserted into the shaft hole 23*a* from an inner side (lower side) of the first cylinder portion 21*a* until the flange portion 20*a* is brought into contact with a lower surface of the partition wall 23 and then, the mounting bolt 24 is screwed with the mounting hole of the flange portion 20*a* through a bolt hole, not shown, from an upper surface side of the partition wall 23, whereby the shaft 20 is fixed to and integrated with the cylinder member 21.

Moreover, in the middle in the axial direction of the shaft 20, a permanent magnet is fixed to the outer peripheral surface, which constitutes a part on a rotor side of a motor portion 25. Magnetic poles formed by the permanent magnet on the outer periphery of the shaft 20 are an N-pole on a half circumference of the outer peripheral surface, while the remaining half circumference is an S-pole.

Moreover, on an upper end side (inlet port 13A side) of the shaft 20, a portion on the rotor 18 side in a radial magnetic bearing portion 26 for supporting the shaft 20 with respect to the motor portion 25 in a radial direction is formed, and a portion on the rotor 18 side in the radial magnetic bearing portion 27 for similarly supporting the shaft 20 with respect to the motor portion 25 in the radial direction is formed. Furthermore, on a lower end of the shaft 20, on a lower end side (outlet port 13B side), a portion on the rotor 18 side of an axial magnetic bearing portion 28 for supporting the shaft 20 in the axial direction (thrust direction) is formed.

In the vicinities of the radial magnetic bearing portions 26, 27, a portion on the rotor 18 sides of radial displacement sensors 29, 30 are formed, respectively, so that displacement of the shaft 20 in the radial direction can be detected.

These portions on the rotor sides of the radial magnetic bearing portions 26, 27 and the radial displacement sensors 29, 30 are constituted by laminated steel plates in which steel plates are laminated in a shaft direction of the rotor 18. This is for preventing occurrence of an eddy current in the shaft 20 by magnetic fields generated by coils constituting the portion on the rotor 18 sides of the radial magnetic bearing portions 26, 27 and the radial displacement sensors 29, 30.

The rotor blade 19 is constituted by using metal such as stainless, aluminum alloy and the like.

On an inner peripheral side of the casing 11, the stator 17 is formed. The stator 17 is constituted by a stator blade 31 and a spacer 34 provided on the inlet port 13A side (turbo-molecular pump portion 10A side), a thread-groove spacer 32 provided on the outlet port 13B side (thread-groove pump portion 10B side), a stator of the motor portion 25, stators of the radial magnetic bearing portions 26, 27, a stator of the axial magnetic bearing portion 28, stators of the radial displacement sensors 29, 30, the stator column 35 and the like.

The stator blade 31 is constituted by a stator-blade blades 33 extending from an inner peripheral surface of the casing 11 toward the shaft 20 with inclination only by a predetermined angle from a plane perpendicular to an axis of the shaft 20. Moreover, regarding the stator blades 31 in the turbo-molecular pump portion 10A, the stator-blade blades 33 are formed in plural stages alternately with the rotor-blade blades 22 of the rotor blade 19 in the axial direction. The stator-blade blades 33 in each stage are separated from each other by the spacer 34 having a cylindrical shape.

The thread-groove spacer 32 is a columnar member in which a spiral groove 32*a* is formed in an inner peripheral surface. The inner peripheral surface of the thread-groove spacer 32 is opposed to an outer peripheral surface of the second cylinder portion 21*b* in the cylinder member 21 with a predetermined clearance (gap) between them. A direction of the spiral groove 32*a* formed in the thread-groove spacer 32 is a direction toward the outlet port 13B when a gas is transported in a rotating direction of the rotor 18 in the spiral groove 32*a*. A depth of the spiral groove 32*a* is configured to become shallower as it gets closer to the outlet port 13B, and the gas transported through the spiral groove 32*a* is compressed as it gets closer to the outlet port 13B.

The stator blade 31 and the thread-groove spacer 32 are constituted by using metal such as stainless, an aluminum alloy and the like.

The pump base 11B is a member having a schematically short cylindrical shape with an opening 39 penetrating in an up-down direction at a center. On an upper surface side of the pump base 11B, the stator column 35 having a cylindrical shape is mounted by inserting and engaging a lower end side in the opening 39 with the upper surface side directed to the direction of the inlet port 13A, concentrically with a center axis of the stator 17. The stator column 35 supports portions on the stator sides of the motor portion 25, the radial magnetic bearing portions 26, 27, and the radial displacement sensors 29, 30. On the other hand, on a lower surface side of the pump base 11B, the base end lid 11C is mounted by the mounting bolt 12B and integrated with the pump base 11B. That is, the base end lid 11C forms the casing 11 together with the pump case 11A and the pump base 11B.

In the motor portion 25, stator coils with a predetermined number of poles are disposed at equal intervals on the inner peripheral sides of the stator coils so that a rotating magnetic field can be generated around magnetic poles formed on the shaft 20.

The radial magnetic bearing portions 26, 27 are constituted by the coils disposed by each 90 degrees around the rotation axis. The radial magnetic bearing portions 26, 27 magnetically float the shaft 20 in the radial direction by attracting the shaft 20 in the magnetic field generated by these coils.

On a bottom part of the stator column 35, the axial magnetic bearing portion 28 is formed. The axial magnetic bearing portion 28 is constituted by a disc extending from the shaft 20 and the coil disposed above and below this disc. The shaft 20 is magnetically floated in the axial direction when the magnetic field generated by these coils attract this disc.

The radical generating device 10C is disposed on a boundary of the turbo-molecular pump portion 10A and the thread-groove pump portion 10B, which is a position in the middle in the axial direction of the rotor 18 disposed in the casing 11 as shown in FIG. 1.

The radical generating device 10C includes the electrode portion 36A and a power source 36B. The power source 36B of the radical generating device 10C applies a high-frequency voltage to electrodes 36*a*1, 36*a*2, 36*a*3, 36*a*4, 36*a*5 of the electrode portion 36A in the radical generating device 10C, and it is provided on an outer side of the casing 11 in some cases. The power source 36B applies the voltage so that electrodes with different + and − are generated on each of the adjacent electrodes 36*a*1, 36*a*2, 36*a*3, 36*a*4, and 36*a*5.

Figure 2A:
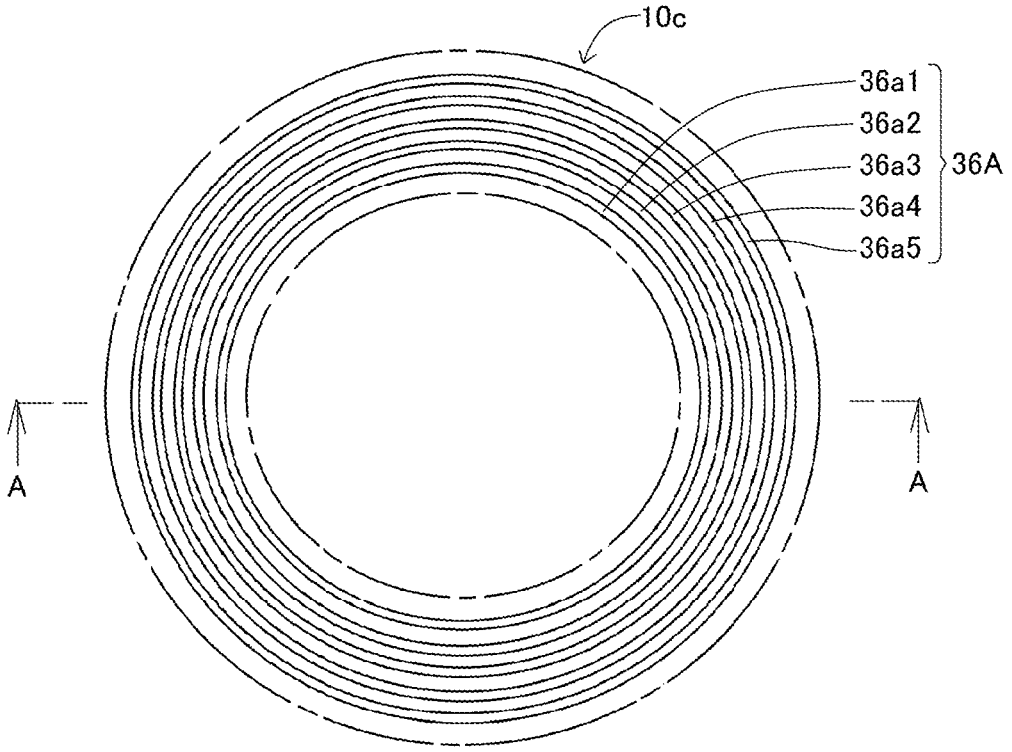
Figure 2B:
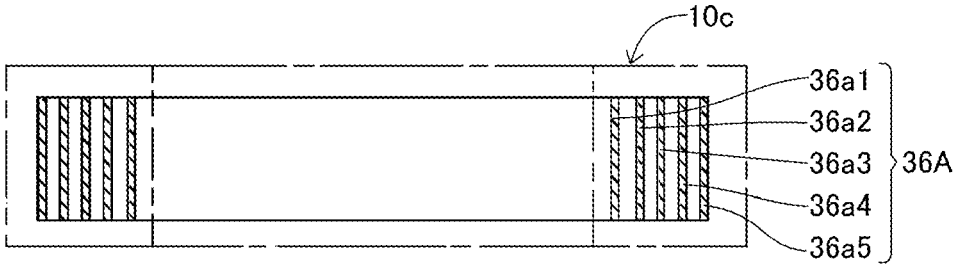

On the other hand, the electrode portion 36A of the radical generating device 10C has, as shown in the plan view thereof in FIG. 2A, the A-A line sectional arrow view of FIG. 2A in FIG. 2B (FIG. 1 also corresponds to the A-A line sectional arrow view), a plurality of (five in this example) electrodes 36*a*1, 36*a*2, 36*a*3, 36*a*4, 36*a*5, each made of a plate material having a cylindrical shape. Each of the electrodes 36*a*1, 36*a*2, 36*a*3, 36*a*4, 36*a*5, has a size of a diameter of each cylinder changed in order at a substantially equal ratio and disposed at substantially equal intervals concentrically with the axial center of the shaft 20. Therefore, a gap between the electrode 36*a*1 and the electrode 36*a*2 is substantially equal to the gap between the electrode 36*a*2 and the electrode 36*a*3, the gap between the electrode 36*a*3 and the electrode 36*a*4, and the gap between the electrode 36*a*4 and the electrode 36*a*5. In addition, in each of the electrodes 36*a*1, 36*a*2, 36*a*3, 36*a*4, 36*a*5, an inner diameter of the electrode 36*a*1 disposed on the innermost side is larger than an outer diameter of the corresponding rotor blade 19, and the outer diameter of the electrode 36*a*5 disposed on the outermost side is formed smaller than the inner diameter of the corresponding pump case 11A.

The electrode portion 36A formed as above is disposed concentrically with the shaft 20 between the rotor 18 and the pump case 11A in a horizontal state substantially perpendicular to the axial center of the shaft 20 so as to cross the entire inside of the passage of the process gas in the casing 11 horizontally. Therefore, in the vacuum pump 10 of this example, the process gas entering from the inlet port 13A and flowing in the casing 11 and the purge gas supplied from the first purge-gas supply port 14A flow toward the outlet port 13B through the gaps between each of the electrodes 36*a*1, 36*a*2, 36*a*3, 36*a*4, 36*a*5 of the electrode portion 36A.

In the radical generating device 10C, in a state where the high-frequency voltage is applied from the power source 36B to each of the electrodes 36*a*1, 36*a*2, 36*a*3, 36*a*4, 36*a*5 of the electrode portion 36A, when the aforementioned purge gas such as O2, NF3 and the like, for example, is supplied from the first purge-gas supply port 14A, the O-radical, the F-radical are generated when the purge gas passes through each of the electrodes 36*a*1, 36*a*2, 36*a*3, 36*a*4, 36*a*5. Moreover, when the O-radical, the F-radical flow toward the outlet port 13B, they function so as to give large energy to the depositions deposited inside the casing 11, to forcedly cut off the molecular chain on the surface of the depositions and to decompose them into a low molecular weight gas, to transport the gas having been decomposed into the low molecular weight to the outlet port 13B, and to exhaust them to the outside of the vacuum pump 10 through the outlet port 13B.

The control portion 10D is constituted by a microcomputer, for example, and controls start/stop of the motor portion 25, the radial magnetic bearing portions 26, 27, the axial magnetic bearing portion 28, the radical generating device 10C, the auxiliary pump communicating with/connected to the first purge-gas supply port 14A, and the auxiliary pump communicating with/connected to the second purge-gas supply port 14B.

The vacuum pump 10 constituted as above operates as follows and exhausts the gas from a vacuum vessel.

First, by means of control of the control portion 10D, the radial magnetic bearing portions 26, 27 and the axial magnetic bearing portion 28 are started, the entire rotor 18 is magnetically floated through the shaft 20, and the rotor 18 is supported in the space in a non-contact manner.

Subsequently, the motor portion 25 is driven by the control of the control portion 10D, and the shaft 20 is rotated in a predetermined direction. That is, the rotor 18 is rotated in the predetermined direction. A rotational speed is approximately 30,000 rotations per minute, for example. In this example, the rotating direction of the rotor 18 is assumed to be a clockwise direction when seen from the inlet port side, but the vacuum pump 10 can be also configured to be rotated in a counterclockwise direction.

When the rotor 18 is rotated, by means of actions of the rotor-blade blades 22 of the rotor blade 19 and the stator-blade blades 33 of the stator blade 31 of the stator 17, the gas is sucked through the inlet port 13A and is compressed more as it goes closer to the lower stage. The gas compressed in the turbo-molecular pump portion 10A is further compressed in the thread-groove pump portion 10B and is exhausted from the outlet port 13B.

By the way, in the vacuum pump 10, in a process of compressing the process gas in the vacuum pump 10, a gas is solidified and deposited inside the casing 11. Thus, the control portion 10D drives the radical generating device 10C between process processing and in a state where the high-frequency voltage is applied to each of the electrodes 36*a*1, 36*a*2, 36*a*3, 36*a*4, 36*a*5 of the electrode portion 36A, the purge gas such as O2, NF3 and the like is further supplied from the first purge-gas supply port 14A, and the purge gas is caused to flow toward the outlet port 13B in the passage through which the process gas flows.

Moreover, when the purge gas is caused to flow, the control portion 10D controls driving of the motor portion 25, switches the rotation of the motor portion 25 to a low-speed rotation lower than rated rotation, and causes the driving of the rotor 18 operated at a low speed. Then, in the state where the rotor 18 is performing constant-speed rotation, the purge gas such as O2, NF3 and the like is caused to flow from the first purge-gas supply port 14A. When the purge gas is caused to flow from the first purge-gas supply port 14A, the O-radical, the F-radical are generated in the radical generating device 10C when the purge gas passes through each of the electrodes 36*a*1, 36*a*2, 36*a*3, 36*a*4, 36*a*5. Moreover, when the generated O-radical, F-radical flow toward the outlet port 13B, upon contact of the O-radical, the F-radical with the depositions deposited inside the casing 11, it gives large energy to the depositions, forcedly cuts off the molecular chain on the surface of the depositions and decomposes them into the low molecular weight gas. Then, the gas having been decomposed into the low molecular weight is exhausted to the outside through the outlet port 13B. As a result, the depositions deposited in the casing 11 can be reduced.

The reason why the rotor 18 is left to be rotated at a low speed when the purge gas is caused to flow is to ensure that the purge gas reliably flows to the outlet port 13B side and does not backflow into the vacuum chamber from the inlet port 13A side so as to avoid corrosion or the like in the vacuum chamber. Therefore, the low molecular weight gas having been decomposed by the purge gas is exhausted to the outside of the casing 11 through the outlet port 13B and thus, the depositions deposited in the casing 11 can be reduced. As a result, the maintenance cycle of the pump can be extended, and the frequency of removing the vacuum pump from the vacuum chamber for overhauling can be decreased.

Moreover, during the driving of the vacuum pump 10, an inactive gas such as an N2 (nitrogen) gas, an Ar (argon) gas and the like is caused to flow into the stator column 35 from the second purge-gas supply port 14B and protects the electric components and the like accommodated in the electric-component accommodating portion 35*a* of the stator column 35 from a corrosive gas.

Moreover, the radicals are unstable substances which forcedly separate the molecular binding by giving large energy to the material gas. Thus, they have a demerit that are bound again in a relatively short time and lose activity. On the other hand, the process gas is deposited in the casing mainly in the vicinity of the outlet port 13B. Therefore, even by supplying the radicals in the vicinity of the inlet port 13A, effective cleaning cannot be performed in some cases. However, with the vacuum pump 10 in this example, since the electrode portion 36A of the radical generating device 10C is provided at the position in the middle in the axial direction of the rotor 18, that is, at the position on the boundary of the turbo-molecular pump portion 10A and the thread-groove pump portion 10B, the depositions of the process gas deposited on the downstream side (the outlet port 13B side) of the electrode portion 36A of the radical generating device 10C, can be effectively decomposed and favorably exhausted to the outside.

Moreover, since the plurality of electrodes 36*a*1, 36*a*2, 36*a*3, 36*a*4, 36*a*5 of the electrode portion 36A in the radical generating device 10C are made cylindrically, respectively, and disposed concentrically, and disposed in the form of crossing the entire passage through which the process gas and the purge gas pass in the casing 11, a space occupied by the radical generating device 10C in the casing 11 can be reduced and can be made compact. As a result, size reduction of the vacuum pump 10 is realized. There only needs to be at least a pair of electrodes in the electrode portion 36A, and the more the number of the electrodes is increased, the larger the generation amount of the radicals is increased, and a decomposition effect of the depositions by the radicals can be further improved.

Figure 3:
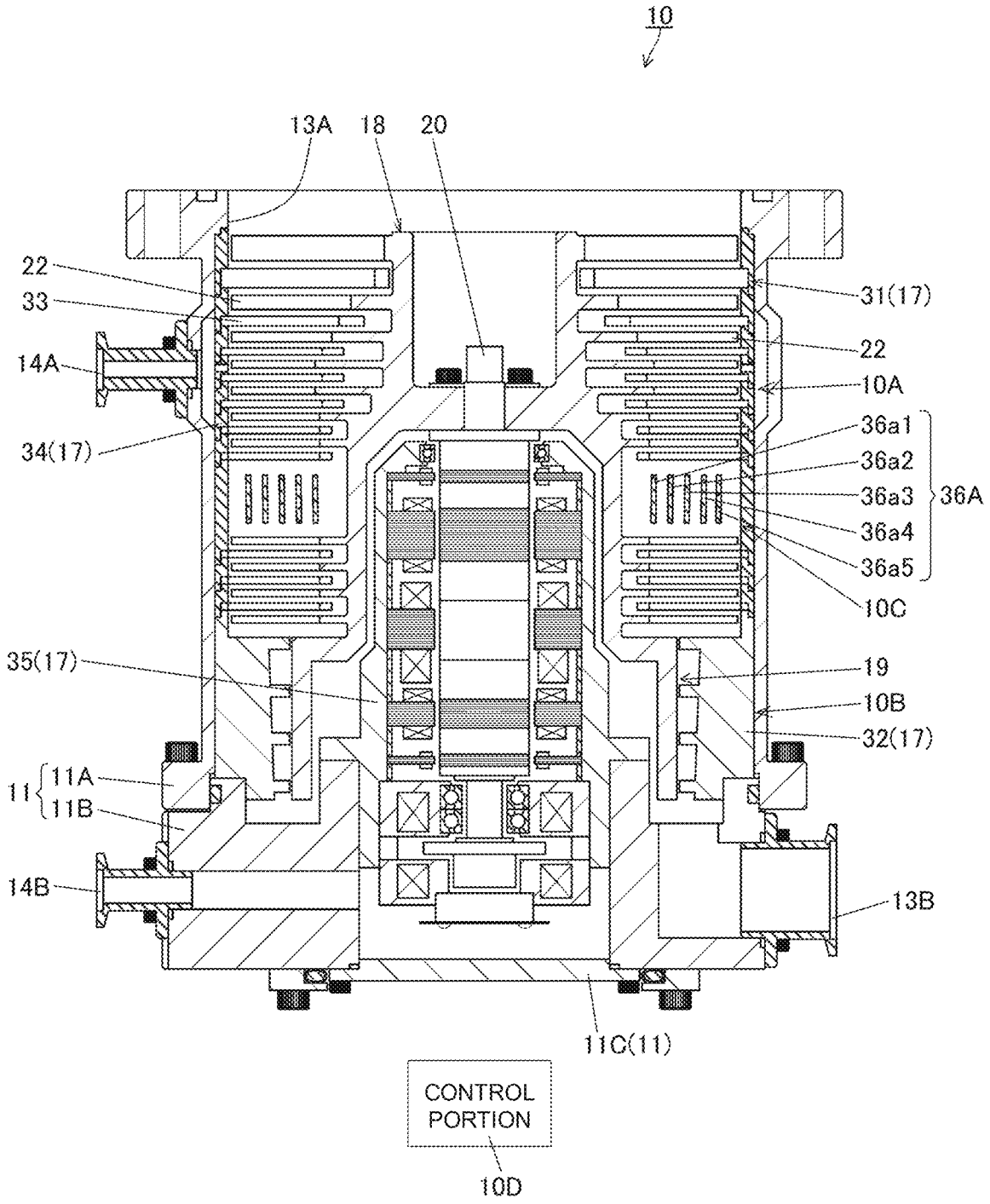
FIG. 3 is a schematic vertical sectional side view of the vacuum pump illustrated as another variation of the vacuum pump shown in FIG. 1.
Figure 4:
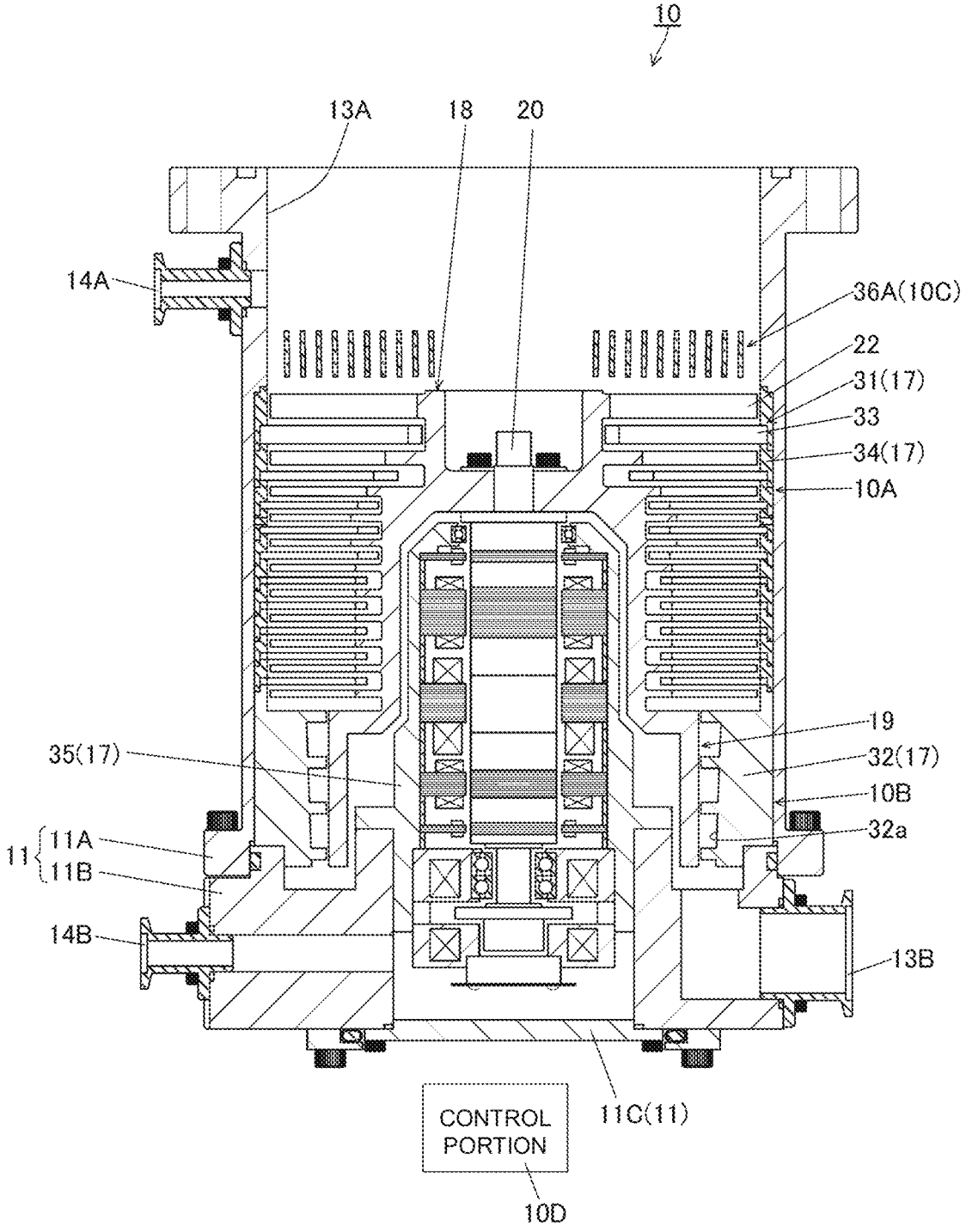
FIG. 4 is a schematic vertical section side view of the vacuum pump illustrated as still another variation of the vacuum pump shown in FIG. 1.

In the structure of the aforementioned example, the structure in which the electrode portion 36A of the radical generating device 10C is disposed at a position in the middle in the axial direction of the rotor 18, that is, in the boundary of the turbo-molecular pump portion 10A and the thread-groove pump portion 10B was disclosed, but the position where the electrode portion 36A of the radical generating device 10C is provided is not limited to the position in the structure of the aforementioned example but may be a position in the vacuum pump 10 shown in FIG. 3, FIG. 4 illustrated as variations of this example, for example.

That is, FIG. 3 is a schematic vertical sectional side view illustrating a variation of the vacuum pump 10 shown in FIG. 1. The members given the same signs in FIG. 3 as those in FIG. 1 are the same members as the members shown in FIG. 1, and duplicated explanation will be omitted.

The vacuum pump 10 shown in FIG. 3 has the electrode portion 36A of the radical generating device 10C provided at the position in the middle in the axial direction of the turbo-molecular pump portion 10A. In the vacuum pump 10 in this variation, the electrode portion 36A of the radical generating device 10C is provided at the position in the middle in the axial direction of the rotor 18, that is, at the position in the middle in the axial direction of the turbo-molecular pump portion 10A and thus, the depositions of the process gas to be deposited on the downstream side (the outlet port 13B side) of the electrode portion 36A of the radical generating device 10C can be effectively decomposed and favorably exhausted to the outside.

FIG. 4 is a schematic vertical sectional side view illustrating another variation of the vacuum pump 10 shown in FIG. 1. The members given the same signs in FIG. 4 as those in FIG. 1 are the same members as the members shown in FIG. 1, and duplicated explanation will be omitted.

The vacuum pump 10 shown in FIG. 4 has the electrode portion 36A of the radical generating device 10C provided at the position between the first purge-gas supply port 14A and the rotor 18 in the axial direction of the rotor 18 in the casing 11. In the vacuum pump 10 in this variation, the electrode portion 36A of the radical generating device 10C is provided at the position between the first purge-gas supply port 14A and the rotor 18 in the casing 11 of the rotor 18 and thus, the space for installing the electrodes can be ensured large, and as a result, the electrodes can be disposed in the number (10 pieces in this variation) larger than that in the vacuum pump 10 shown in FIGS. 1 and 3, and the radicals can be generated more. As a result, the depositions of the process gas passing through the turbo-molecular pump portion 10A and the thread-groove pump portion 10B on the downstream side (the outlet port 13B side) of the electrode portion 36A of the radical generating device 10C can be further effectively decomposed and favorably exhausted to the outside through the outlet port 13B.

The present disclosure can be altered in various ways, as long as the spirit of the present disclosure is not departed, and it is natural that the present disclosure covers the altered ones.

Moreover, description was made by using the example in which the spiral-shaped spiral groove 32*a* is provided in the inner peripheral surface of the fixed cylinder (thread-groove spacer 32), but the thread-groove pump portion 10B may be constituted by providing the spiral-shaped thread groove on the outer peripheral surface side of the second cylinder portion 21*b* of the cylinder member 21 or by providing the spiral-shaped thread groove on the both.

Furthermore, the thread-groove pump portion 10B may be constituted by providing a disc protruding from the outer peripheral surface of the cylinder member 21 and a disc protruding from the inner side surface of the casing 11 and by providing a spiral-shaped thread groove in an opposed surface.

What is claimed is:

1. A vacuum pump, comprising:

a casing;

a stator disposed on an inner side of the casing;

a cylindrical rotor having a shaft rotatably supported with respect to the stator and rotatably enclosed in the casing together with the shaft;

a pair of electrodes enclosed in the casing and disposed on a boundary of a turbo-molecular pump portion and a thread-groove pump portion, wherein the pair of electrodes are constituted by disposing a plurality of cylindrically formed plate materials at a plurality of equal intervals concentrically with an axial center of the shaft such that the pair of electrodes evenly decompose and exhaust a process gas deposited in a periphery of the boundary of the turbo-molecular pump portion and the thread-groove pump portion; and a power source that applies a high-frequency voltage to the pair of electrodes to generate radicals when a purge gas passes through the pair of electrodes.

2. The vacuum pump according to claim 1, wherein the turbo-molecular pump portion includes a plurality of rotor-blade blades protruding from an outer peripheral part of the cylindrical rotor, and stator-blade blades protruding from an inner peripheral part of the casing, separated away in an axial direction with respect to the plurality of rotor-blade blades and disposed by surface-facing the plurality of rotor-blade blades.

3. The vacuum pump according to claim 1, wherein the thread-groove pump portion includes a spiral or a coiled thread groove provided at least in either one of an outer peripheral part of the cylindrical rotor or an inner peripheral part of the stator.

4. The vacuum pump according to claim 1, wherein the turbo-molecular pump portion includes a plurality of rotor-blade blades protruding from an outer peripheral part of the cylindrical rotor and stator-blade blades protruding from an inner peripheral part of the casing, separated away in an axial direction with respect to the plurality of rotor-blade blades, and disposed by surface-facing the plurality of rotor-blade blades; and wherein the thread-groove pump portion includes a spiral or coiled thread groove at least in either one of an outer peripheral part of the cylindrical rotor or an inner peripheral part of the stator.

5. The vacuum pump according to claim 1, wherein the pair of electrodes are provided closer to an inlet port side than the cylindrical rotor.

6. The vacuum pump according to claim 1, wherein the pair of electrodes are provided at a position in a middle in an axial direction of the cylindrical rotor.

7. The vacuum pump according to claim 1, wherein a purge-gas supply port that supplies the purge gas, wherein the purge-gas supply port is provided on an upstream side of the pair of electrodes in the casing.

8. The vacuum pump according to claim 1, further comprising:

a control portion capable of switching control of the cylindrical rotor between rated rotation and a low-speed rotation at a speed lower than a rated speed.

* * * * *